US010596051B2

(12) United States Patent
Purdy et al.

(10) Patent No.: US 10,596,051 B2
(45) **Date of Patent: *Mar. 24, 2020**

(54) SYSTEM AND METHOD FOR PATIENT TURNING AND REPOSITIONING WITH SIMULTANEOUS OFF-LOADING OF THE BODY IN THE PRONE POSITION

(71) Applicant: MÖLNLYCKE HEALTH CARE AB, Gothenburg (SE)

(72) Inventors: William Purdy, White Plains, NY (US); Robert Purdy, Bedford, NY (US)

(73) Assignee: MOLNLYCKE HEALTH CARE AB, Gothenburg (SE)

( * ) Notice: Subject to any disclaimer, the term of this patent is extended or adjusted under 35 U.S.C. 154(b) by 270 days.

This patent is subject to a terminal disclaimer.

(21) Appl. No.: 15/730,268

(22) Filed: Oct. 11, 2017

(65) Prior Publication Data

US 2018/0028381 A1 Feb. 1, 2018

Related U.S. Application Data

(63) Continuation of application No. 13/834,911, filed on Mar. 15, 2013, now Pat. No. 9,833,371, which is a (Continued)

(51) Int. Cl.
*A61G 7/10* (2006.01)
*A61G 7/00* (2006.01)
(Continued)

(52) U.S. Cl.
CPC ..... *A61G 7/1026* (2013.01); *A61G 7/001* (2013.01); *A61G 7/109* (2013.01); *A61G 7/1021* (2013.01);
(Continued)

(58) Field of Classification Search
CPC ..... A61G 7/001; A61G 7/05792; A61G 7/05753; A61G 7/05776; A61G 7/1021;
(Continued)

(56) References Cited

U.S. PATENT DOCUMENTS 1,334,901 A * 3/1920 Higdon ..... A61G 7/1026 5/500
2,466,142 A 4/1949 Yost
(Continued)

FOREIGN PATENT DOCUMENTS

AU 2015311732 A1 4/2017
CN 201208361 3/2009
(Continued)

OTHER PUBLICATIONS

AirPal® Patient Air Lift, Hill-Rom®, Retrieved from the internet at https://web.archive.org/web/20101015045524/http://www.hill-rom.com/usa/AirPal.htm, Oct. 15, 2010, 1 page.
(Continued)

*Primary Examiner* — David R Hare
(74) *Attorney, Agent, or Firm* — Kilpatrick Townsend & Stockton LLP

(57) ABSTRACT

The present invention relates to a system and method for sacral and trochanteric support and off-loading. The system provides a ultra low pressure plenum and a positioner. The patient body size and size and corresponding surface area of the positioner control the amount of gas which is displaced evenly against the walls of the ultra low pressure plenum to allow the combination of the ultra low pressure plenum and the positioner to slightly lift a patient from a bed surface, thereby offloading the sacrum and trochanter. The positioner can be an ultra low pressure bladder.

23 Claims, 20 Drawing Sheets

Related U.S. Application Data continuation-in-part of application No. 13/493,582, filed on Jun. 11, 2012, now Pat. No. 9,504,621, and a continuation of application No. 13/493,641, filed on Jun. 11, 2012, now Pat. No. 9,814,642.

(60) Provisional application No. 61/614,791, filed on Mar. 23, 2012, provisional application No. 61/495,096, filed on Jun. 9, 2011, provisional application No. 61/495,089, filed on Jun. 9, 2011.

(51) Int. Cl.
*A61G 1/01* (2006.01)
*A61G 7/057* (2006.01)

(52) U.S. Cl.
CPC ..... *A61G 7/1023* (2013.01); *A61G 7/1025* (2013.01); *A61G 1/01* (2013.01); *A61G 7/05753* (2013.01); *A61G 7/05776* (2013.01)

(58) Field of Classification Search
CPC .. A61G 7/1023; A61G 7/1025; A61G 7/1026; A61G 7/1051; A61G 7/109; A61G 1/01
See application file for complete search history.

(56) References Cited

U.S. PATENT DOCUMENTS 2,489,828 A 11/1949 Springer
2,748,399 A 6/1956 Joseph
3,158,875 A 12/1964 Fletcher
3,212,497 A 10/1965 Dickinson
3,331,087 A 7/1967 Barlow
3,526,908 A 9/1970 Davis
3,762,404 A 10/1973 Sakita
3,769,642 A * 11/1973 Warman ..... A61G 7/1026 5/81.1 T
3,829,914 A * 8/1974 Treat ..... A47C 21/00 5/81.1 T
3,840,920 A 10/1974 Voelker
3,849,813 A * 11/1974 Neilson ..... A47G 9/0238 5/495
3,968,530 A 7/1976 Dyson
4,005,498 A 2/1977 Starr et al.
4,024,861 A 5/1977 Vincent
4,045,830 A 9/1977 Loeb et al.
4,051,565 A * 10/1977 Berge ..... A61G 7/1032 5/81.1 R
4,139,920 A * 2/1979 Evans ..... A47C 3/16 5/420
4,211,218 A 7/1980 Kendrick
4,213,213 A 7/1980 Burnett
4,272,856 A 6/1981 Wegener et al.
4,347,213 A 8/1982 Rogers, Jr.
4,371,997 A * 2/1983 Mattson ..... A47C 27/081 297/DIG. 3
4,428,087 A 1/1984 Horn
4,472,847 A 9/1984 Gammons et al.
4,493,877 A * 1/1985 Burnett ..... A47C 31/126 428/542.8
4,517,690 A 5/1985 Wegener
4,566,445 A 1/1986 Jelsma et al.
4,665,908 A 5/1987 Calkin
4,736,474 A 4/1988 Moran et al.
4,741,057 A 5/1988 Rosier et al.
4,977,629 A 12/1990 Jones
4,989,285 A * 2/1991 Troncone ..... A47D 15/00 5/482
5,009,318 A * 4/1991 Lepinoy ..... A61G 7/05753 128/DIG. 20
5,044,031 A 9/1991 Sherwood et al.
5,060,324 A 10/1991 Marinberg et al.
5,065,464 A 11/1991 Blanchard et al.
5,067,189 A 11/1991 Weedling et al.
5,092,007 A 3/1992 Hasty
5,103,517 A 4/1992 Krouskop
5,103,518 A 4/1992 Gilroy et al.
5,121,756 A 6/1992 Koledin
5,243,722 A 9/1993 Gusakov
5,329,655 A 7/1994 Garner
5,421,874 A 6/1995 Pearce
5,489,259 A 2/1996 Jacobs et al.
5,549,743 A 8/1996 Pearce
5,556,169 A * 9/1996 Parrish ..... A42B 3/121 297/452.28
5,626,150 A 5/1997 Johnson et al.
5,626,657 A 5/1997 Pearce
5,708,999 A 1/1998 Priolo et al.
5,742,958 A * 4/1998 Solazzo ..... A61G 7/1026 5/81.1 HS
5,794,289 A 8/1998 Wortman et al.
5,806,796 A 9/1998 Healey
5,832,550 A * 11/1998 Hauger ..... A61B 5/1078 5/621
5,869,164 A 2/1999 Nickerson et al.
5,901,392 A 5/1999 Hsieh
5,966,754 A * 10/1999 Schuster ..... A61G 7/1032 5/81.1 R
5,966,763 A 10/1999 Thomas et al.
6,020,055 A 2/2000 Pearce
6,073,291 A 6/2000 Davis
6,110,006 A 8/2000 Chen
6,119,292 A 9/2000 Haas
6,128,796 A 10/2000 McCormick et al.
6,145,143 A 11/2000 Hicks et al.
6,151,739 A 11/2000 Meyer et al.
6,154,900 A 12/2000 Shaw
6,158,070 A 12/2000 Bolden et al.
6,175,980 B1 1/2001 Gaither
6,192,537 B1 2/2001 Miki
6,197,099 B1 3/2001 Pearce
6,209,159 B1 4/2001 Murphy
6,209,962 B1 4/2001 Sobel et al.
6,226,820 B1 5/2001 Navarro
6,254,959 B1 7/2001 Hirano et al.
6,318,372 B1 11/2001 Hiebert
6,327,724 B1 12/2001 Sharrock et al.
6,343,385 B1 2/2002 Katz
6,351,863 B1 3/2002 Meyer et al.
6,357,066 B1 3/2002 Pierce
6,381,787 B1 5/2002 Rogone et al.
6,397,419 B1 6/2002 Mechache
6,421,859 B1 7/2002 Hicks et al.
6,425,399 B1 7/2002 Hoster, Jr.
6,498,198 B2 12/2002 Pearce
6,499,166 B1 12/2002 Jones
6,588,511 B1 7/2003 Kriesel et al.
6,604,252 B1 8/2003 Lee et al.
6,701,544 B2 3/2004 Heimbrock
6,718,584 B2 4/2004 Rabaiotti et al.
6,823,549 B1 11/2004 Hampton et al.
6,857,151 B2 2/2005 Jusiak et al.
6,874,176 B2 * 4/2005 Berge ..... A61G 7/05707 5/627
6,896,065 B2 5/2005 Kriesel et al.
6,986,170 B2 1/2006 Nelson
7,007,330 B2 3/2006 Kuiper et al.
7,020,912 B2 4/2006 Berge
7,032,261 B2 4/2006 Heimbrock
7,055,190 B2 6/2006 Barth et al.
7,065,815 B2 6/2006 Buchanan
7,080,422 B2 7/2006 Ben-Levi
7,146,660 B2 12/2006 Heimbrock
7,200,956 B1 4/2007 Kotha et al.
7,243,382 B2 7/2007 Weedling et al.
7,266,852 B2 9/2007 Davis
7,340,785 B2 3/2008 Weedling et al.
7,360,543 B1 4/2008 Coleman et al.
7,415,738 B2 8/2008 Weedling et al.
7,424,760 B2 9/2008 Chaffee
7,464,422 B2 12/2008 Townsend
7,467,431 B2 12/2008 Weedling et al.
7,559,103 B2 7/2009 Barth et al.

(56) References Cited

U.S. PATENT DOCUMENTS

| | | | | |
|---|---|---|---|---|
| 7,565,710 | B2 | 7/2009 | Chambers et al. | |
| 7,591,029 | B2 | 9/2009 | Weedling et al. | |
| 7,650,654 | B2 * | 1/2010 | Lambarth | A61G 7/1026 5/81.1 C |
| 7,681,262 | B2 | 3/2010 | Weedling et al. | |
| 7,725,963 | B2 | 6/2010 | Johnson | |
| 7,739,758 | B2 | 6/2010 | Weedling et al. | |
| 7,832,039 | B2 | 11/2010 | Chambers et al. | |
| 7,900,299 | B2 | 3/2011 | Weedling et al. | |
| 7,904,971 | B2 | 3/2011 | Doria et al. | |
| 7,945,979 | B1 | 5/2011 | Lin | |
| 7,975,331 | B2 | 7/2011 | Flocard et al. | |
| 8,001,636 | B2 | 8/2011 | Nissen et al. | |
| 8,096,003 | B2 | 1/2012 | Schuster | |
| 8,171,585 | B2 | 5/2012 | Mead et al. | |
| 8,176,585 | B1 | 5/2012 | Isham | |
| 8,191,188 | B2 | 6/2012 | Kaplan et al. | |
| 8,234,727 | B2 | 8/2012 | Schreiber et al. | |
| 8,261,388 | B1 | 9/2012 | Gill et al. | |
| 8,302,222 | B2 | 11/2012 | Jasani | |
| 8,387,187 | B2 | 3/2013 | Hieronimi et al. | |
| 8,418,296 | B1 | 4/2013 | Hanlon et al. | |
| 8,555,890 | B2 | 10/2013 | Hiebert | |
| 8,566,977 | B2 | 10/2013 | Davis | |
| 8,607,385 | B2 * | 12/2013 | Isham | A61G 13/123 5/621 |
| 8,661,580 | B2 | 3/2014 | Giap | |
| 8,667,631 | B2 | 3/2014 | Coates | |
| 8,671,479 | B2 * | 3/2014 | Huttner | A61G 7/05753 5/630 |
| 8,690,807 | B2 | 4/2014 | Hiebert | |
| 8,701,225 | B1 | 4/2014 | Latiff | |
| 8,756,725 | B2 | 6/2014 | Piegdon et al. | |
| 8,789,533 | B2 | 7/2014 | Steffens et al. | |
| 8,850,634 | B2 | 10/2014 | Ponsi et al. | |
| 8,858,478 | B2 | 10/2014 | Purdy et al. | |
| 8,898,833 | B2 | 12/2014 | Coates | |
| 8,984,681 | B2 | 3/2015 | Ponsi | |
| 9,149,402 | B2 | 10/2015 | Gil Gomez et al. | |
| 9,375,343 | B2 * | 6/2016 | Marshall | A61F 5/3776 |
| 9,445,933 | B2 | 9/2016 | Williams | |
| 9,504,621 | B2 * | 11/2016 | Purdy | A61G 7/1032 |
| 9,782,313 | B2 * | 10/2017 | Hindson | A61G 7/1032 |
| 9,814,642 | B2 | 11/2017 | Purdy et al. | |
| 9,833,371 | B2 * | 12/2017 | Purdy | A61G 7/1026 |
| 10,363,185 | B2 * | 7/2019 | Purdy | A61G 7/1026 |
| 2002/0104535 | A1 | 8/2002 | Biondo et al. | |
| 2002/0144343 | A1 | 10/2002 | Kuiper et al. | |
| 2003/0192123 | A1 | 10/2003 | Chaffee | |
| 2003/0200611 | A1 | 10/2003 | Chaffee | |
| 2004/0083550 | A1 | 5/2004 | Graebe, Jr. | |
| 2005/0028273 | A1 | 2/2005 | Weedling et al. | |
| 2006/0037136 | A1 | 2/2006 | Weedling et al. | |
| 2006/0179577 | A1 | 8/2006 | Chaffee | |
| 2007/0083995 | A1 | 4/2007 | Purdy et al. | |
| 2007/0118993 | A1 | 5/2007 | Bates | |
| 2007/0283496 | A1 | 12/2007 | Skripps | |
| 2008/0083067 | A1 | 4/2008 | Wheeldon-Glazener | |
| 2008/0134442 | A1 | 6/2008 | Hui | |
| 2008/0201855 | A1 | 8/2008 | Groves | |
| 2009/0106893 | A1 | 4/2009 | Blevins | |
| 2009/0271928 | A1 | 11/2009 | Tishby | |
| 2010/0096419 | A1 | 4/2010 | Stephens | |
| 2010/0170037 | A1 | 7/2010 | Fletcher et al. | |
| 2011/0220695 | A1 | 9/2011 | Saunders et al. | |
| 2011/0241300 | A1 | 10/2011 | Schioler et al. | |
| 2011/0271444 | A1 | 11/2011 | Davis | |
| 2012/0011658 | A1 | 1/2012 | Weedling et al. | |
| 2012/0049605 | A1 | 3/2012 | Sanefuji et al. | |
| 2012/0079656 | A1 | 4/2012 | Lewis | |
| 2012/0186587 | A1 | 7/2012 | Steffens et al. | |
| 2012/0284923 | A1 | 11/2012 | Jensen et al. | |
| 2012/0311781 | A1 | 12/2012 | Purdy et al. | |
| 2012/0311787 | A1 | 12/2012 | Purdy et al. | |
| 2012/0311788 | A1 | 12/2012 | Jackson, II | |
| 2013/0061396 | A1 | 3/2013 | Lafleche et al. | |
| 2013/0145559 | A1 | 6/2013 | Purdy et al. | |
| 2013/0152950 | A1 | 6/2013 | Giap | |
| 2013/0180046 | A1 | 7/2013 | Davis, Jr. | |
| 2013/0198950 | A1 | 8/2013 | Purdy et al. | |
| 2013/0205495 | A1 | 8/2013 | Ponsi et al. | |
| 2013/0230685 | A1 | 9/2013 | Smith | |
| 2013/0276235 | A1 | 10/2013 | Kenalty et al. | |
| 2013/0340770 | A1 | 12/2013 | Starr et al. | |
| 2014/0007353 | A1 | 1/2014 | Stryker et al. | |
| 2014/0041114 | A1 | 2/2014 | Davis | |
| 2014/0075673 | A1 | 3/2014 | Weedling et al. | |
| 2015/0052685 | A1 | 2/2015 | Bhat et al. | |
| 2015/0101126 | A1 | 4/2015 | Reiners et al. | |
| 2015/0128341 | A1 | 5/2015 | Kuiper et al. | |
| 2015/0135443 | A1 | 5/2015 | Cortez | |
| 2015/0157521 | A1 | 6/2015 | Williams et al. | |
| 2015/0238378 | A1 | 8/2015 | Bhat et al. | |
| 2015/0290848 | A1 | 10/2015 | Sanefuji et al. | |
| 2016/0067126 | A1 | 3/2016 | Purdy et al. | |

FOREIGN PATENT DOCUMENTS

| | | | |
|---|---|---|---|
| CN | 106687096 | | 5/2017 |
| DE | 4447431 | | 6/1996 |
| EP | 0821928 | | 2/1998 |
| EP | 3038584 | A1 | 7/2016 |
| EP | 3038584 | A4 | 5/2017 |
| GB | 2300845 | | 11/1996 |
| GB | 2484885 | | 5/2012 |
| IN | 5020DELNP2006 | | 8/2007 |
| JP | 58160035 | U | 10/1983 |
| WO | 0137774 | | 5/2001 |
| WO | 2014043525 | | 3/2014 |
| WO | 2015057775 | | 4/2015 |
| WO | 2015128618 | | 9/2015 |
| WO | 2015130703 | | 9/2015 |
| WO | 2016037108 | | 3/2016 |

OTHER PUBLICATIONS

AIRPAL® Patient Transfer System, Hill-Rom®, http://www.discovermymobility.com/store/patient-lifts/hill-rom/hill-rom-patient-transfer-system.pdf, Dec. 22, 2008, 2 pages.

AirSlide for Lateral Transfer in-Service Video, McAuley Medical, Inc., https://www.youtube.com/watchv=u0tjtK_4gOE, Mar. 14, 2009, 2 pages.

EMS IMMOBILE-VAC™, retrieved from the internet at https://web.archive.org/web/20081120122715/http://www.mdimicrotek.com/prod_emsimmobilevac.htm MDI—Medical Devices International, Nov. 20, 2008, 5 pages.

EZ Matt, EZ Way, Inc., retrieved from the internet at https://web.archive.org/web/20090202082654/http://ezlifts.com/products/product_details.cfmProductID=27, Feb. 2, 2009, 2 pages.

Liftaem™—Revolutionary Lateral Patient Transfer Device, Smart Medical Technology, Inc.®, https://www.youtube.com/watchv=K7_9XA-dS5k, Apr. 4, 2008, 2 pages.

Stryker Glide Lateral Air Transfer System, https://www.stryker.com/stellent/groups/public/documents/web_content/glidespecsheetrevd.pdf, 2009, 2 pages.

Blue Chip Medical Products, Inc., Power Pro Elite® Mattress System—Model 9500, Retrieved from the internet at https://web.archive.org/web/20100501171106/http://www.bluechipmedical.com/mattresssystems/air-mattress/power-pro-elite, May 1, 2010, 4 pages.

*European Application No. 15837218.5, Extended European Search Report dated Mar. 30, 2017, 9 pages.

Hovertech, HoverMatt® Air Transfer System, Retrieved from the internet at https://web.archive.org/web/20110208085745/http://www.hovermatt.com/reusable, Feb. 8, 2011, 1 page.

International Application No. PCT/US2015/048642, International Preliminary Report on Patentability dated Mar. 16, 2017, 8 pages.

International Application No. PCT/US2015/048642, International Search Report and Written Opinion dated Dec. 2, 2015, 9 pages.

Sundance Enterprises, Inc., The DAP 210 Static Overlay Mattress, Healthcare Products, Retrieved from the internet at https://web.

(56) References Cited

OTHER PUBLICATIONS archive.org/web/20061014205929/http://sundancesolutions.com/dap210.php, Oct. 14, 2006, 2 pages.
Sundance Enterprises, Inc., The DAP Series, Static Air Support System and Fluidized Positioners, Healthcare Products, retrieved from the internet at https://web.archive.org/web/20061013091949/http://sundancesolutions.com/healthcareproducts.php, Oct. 13, 2006, 1 page.
U.S. Appl. No. 14/845,062, Non-Final Office Action dated Feb. 9, 2018, 17 pages.
U.S. Appl. No. 14/845,062, "Non-Final Office Action", dated Nov. 26, 2018, 12 pages.
AU2015311732, "Notice of Acceptance", dated Oct. 9, 2018, 3 pages.
CN201580047648.7, "Office Action", dated Sep. 3, 2018, 8 pages.
CN201580047648.7, "Office Action", dated Aug. 20, 2019, 7 pages.
PCT/IB2019/054348, "International Search Report and Written Opinion", dated Sep. 20, 2019, 13 pages.

* cited by examiner

SYSTEM AND METHOD FOR PATIENT TURNING AND REPOSITIONING WITH SIMULTANEOUS OFF-LOADING OF THE BODY IN THE PRONE POSITION

CROSS REFERENCE TO RELATED APPLICATIONS

This application is a continuation of U.S. application Ser. No. 13/834,911, filed Mar. 15, 2013, titled "SYSTEM AND METHOD FOR PATIENT TURNING AND REPOSITIONING WITH SIMULTANEOUS OFF-LOADING OF THE BONY PROMINENCES," now U.S. Pat. No. 9,833,371, which application is a continuation-in-part of U.S. application Ser. No. 13/493,582, filed Jun. 11, 2012, titled "SYSTEM AND METHOD FOR PATIENT TURNING AND REPOSITIONING WITH SIMULTANEOUS OFF-LOADING OF THE BONY PROMINENCES," now U.S. Pat. No. 9,504,621, which application claims the benefit of U.S. Provisional Application No. 61/614,791, filed Mar. 23, 2012 and U.S. Provisional Application No. 61/495,089, filed Jun. 9, 2011, the entire contents of each of which are hereby incorporated by reference. This application is also a continuation of U.S. application Ser. No. 13/493,641, filed Jun. 11, 2012 titled "MATTRESS SYSTEM INCLUDING LOW PRESSURE COMMUNICATION AIR CHAMBER," now U.S. Pat. No. 9,814,642, which application claims the benefit of U.S. Provisional Application No. 61/495,096, filed Jun. 9, 2011, the entire contents of each of which are hereby incorporated by reference.

BACKGROUND OF THE INVENTION

1. Field of the Invention

The present invention relates to a patient support which can be used in a bed or flat surface and in particular to a system and method for support of the body, in particular in the prone position, which can also be used for turning and repositioning of a patient in a bed or on a flat surface.

2. Description of Related Art

Hospital bed and other patient static air and dynamic air supports are known. Typically, such patient supports are used to provide a support surface for patients or other individuals for treatment, recuperation, or rest and prevention of skin breakdown.

It is desirable to provide an improved support off-loading the patient in the prone position including bony prominences.

SUMMARY OF THE INVENTION

The present invention relates to a system and method for body support and off-loading. It is optimal to barely elevate the body in a prone position from the surface of the bed. In the prone position, the body is laying face forward towards the support surface. The system provides a support including a first ultra low pressure plenum, a second ultra low pressure plenum and a positioner. Each of the ultra low pressure plenums can include one or more air chambers. Each air chamber is filled at a predetermined low pressure for distributing pressure along the length of the ultra low pressure plenum, but not providing significant elevation of a received body part by itself.

A cover can be received over the ultra low plenums. The cover can include a retaining member for receiving the positioner. The cover can include a temperature regulating material for keeping the received body part in an optimal range of skin temperature to keep comfortable longer. In one embodiment, a phase change material can be used for adjusting the temperature of the system to adapt to temperature changes of the body.

The positioner includes a bladder preferably filled with a fluidized particulate material with sufficient size and shape to displace an amount of air in the support to offload pressure being from a received body part, such as, but not limited to, bony prominences of which contact a surface when the body is positioned in a prone position and when the body is turned to other positions. The surface area of the positioner provides greater positive air displacement in the ultra low pressure plenums than would occur from the body part of the patient by itself. In one embodiment, the positioner can have a greater width than the patient. The positioner provides three dimensional movement. Preferably, the positioner has little or no flow characteristics unless an outside force is applied other than gravity. The positioner can displace and contour three dimensionally as though it was fluid while not having flow characteristics that would result in migration of the medium under the force of gravity. The positioner can provide three dimensional contouring. The positioner can be shaped as a pad.

In one embodiment, the first ultra low pressure plenum includes a lower bladder section having a smaller width dimension than an upper bladder section. The air chambers of the lower bladder section and the upper bladder section being in air communication with one another. Air is communicated within the upper bladder section and lower bladder section through air displacement. The patient body size and size and corresponding surface area of the positioner control the amount of air which is displaced evenly against the walls of the first ultra low pressure plenum. A second ultra low pressure plenum is placed under the first ultra low pressure plenum. Alternatively, the second ultra low pressure plenum can be placed on top of the first ultra low pressure plenum. The second ultra low pressure plenum can have a size and shape identical or substantially similar to the upper bladder section of the first ultra low pressure plenum. The positioner is placed beneath or on top of both the first ultra low pressure plenum and the second ultra low pressure plenum or at other positions of the first ultra low pressure plenum and the second low pressure plenum or in combination one or more additional positioners. In one embodiment, the positioner displaces air in both the first ultra low pressure plenum and the second ultra low pressure plenum to off-load the body and allow the lungs to expand in a prone position of the body. In one embodiment, the positioner can be positioned at one of outer walls of the first ultra low pressure plenum to push air away from the outer wall, thereby aiding in turning of a patient.

For example, the support can be used to allow a patient to be supported in the prone position for off-loading the body from the collar bone to the knees to aid in treating advanced respiratory distress.

The combination of the first and second ultra low pressure plenums and positioner, including a fluidized medium, creates sufficient support of the received body part while responding to normal patient movement. The first and second ultra low pressure plenums can be low profile. In one embodiment, the system including the first and second ultra low pressure plenums can be positioned underneath the sheets of a bed, such as a hospital bed. Alternatively, the system including the first and second ultra low pressure plenums can be placed above the sheets for aiding in patient turning and repositioning.

Gripping handles can be provided on either edge of the first ultra low pressure plenum to aid in movement of the first ultra low pressure plenum when a patient supported by the first ultra low pressure plenum. In this embodiment, the gripping handles can be placed over the sheet and unweighted to allow the patient to be moved for turning and repositioning of the patient. In one embodiment, the gripping handles are holes in the cover. In an alternative embodiment, the gripping handles are placed under the sheet and have a high coefficient of friction to prevent movement of the ultra low pressure plenum.

The invention will be more fully described by reference to the following drawings.

BRIEF DESCRIPTION OF THE DRAWINGS

FIG. 4 is a schematic diagram of the system including the positioner positioned at an outer wall of the support.

DETAILED DESCRIPTION

Figure 1A:
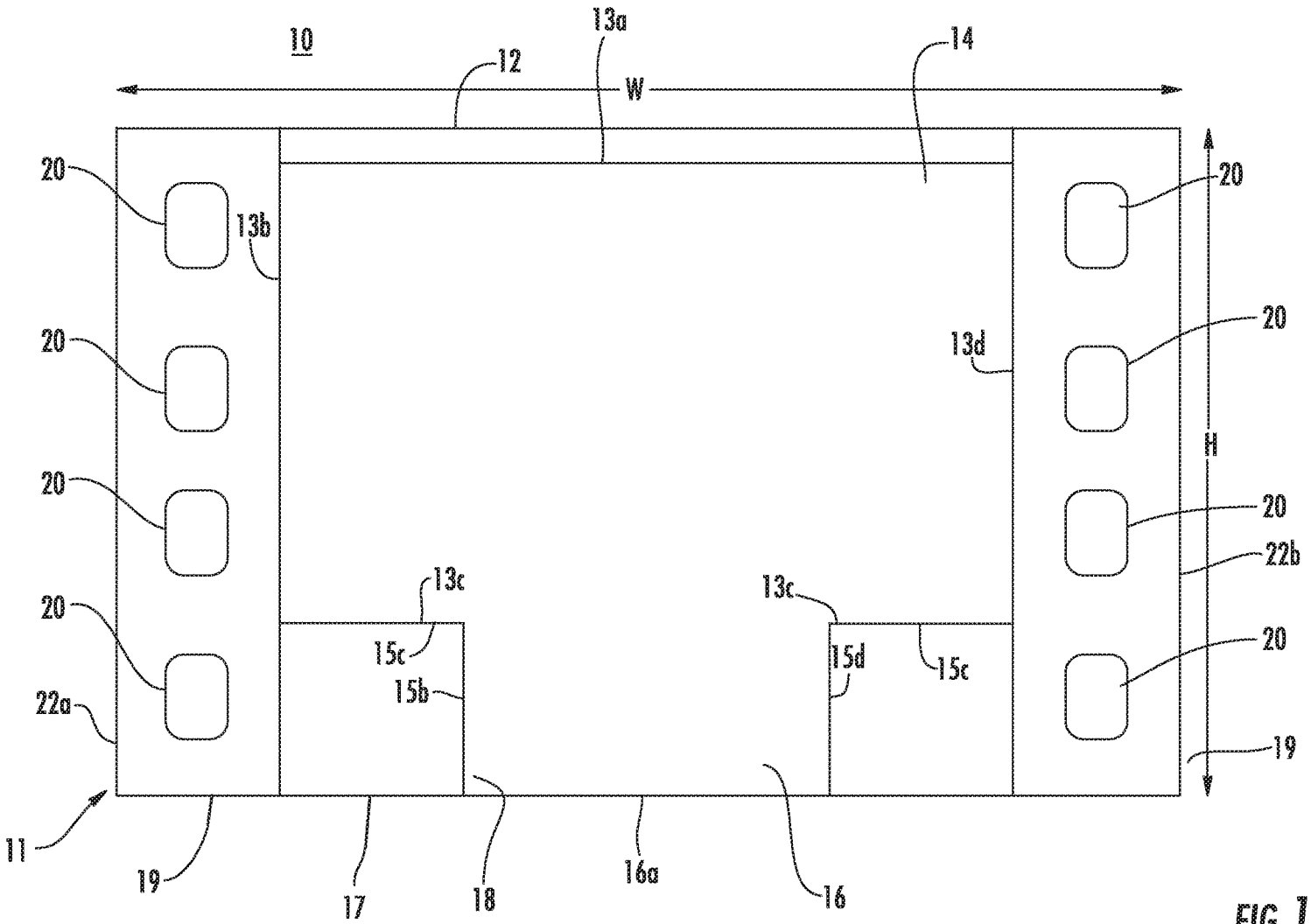
FIGS. 1A-1C are a schematic diagrams of a first bladder used in a system for body support in accordance with the teachings of the present invention.
Figure 1B:
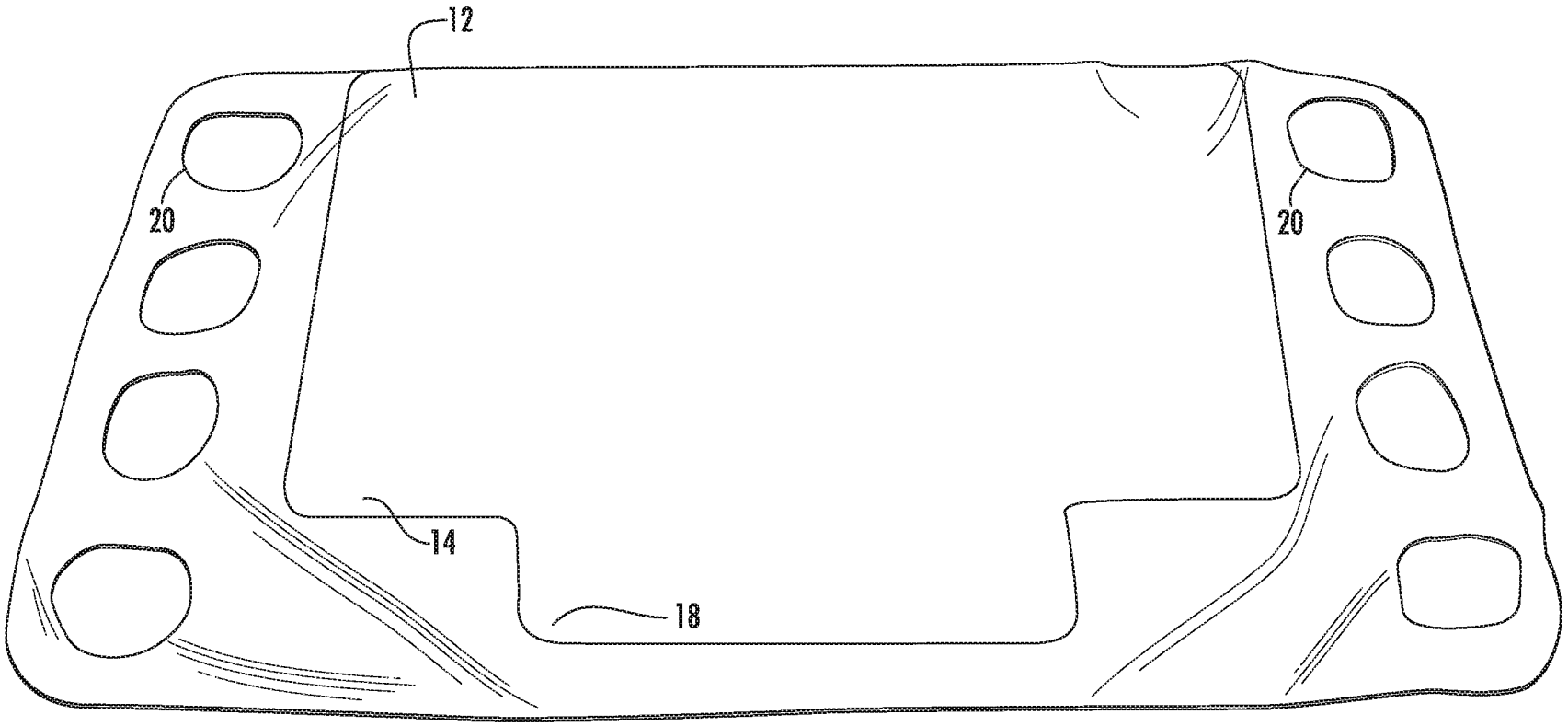
Figure 1C:
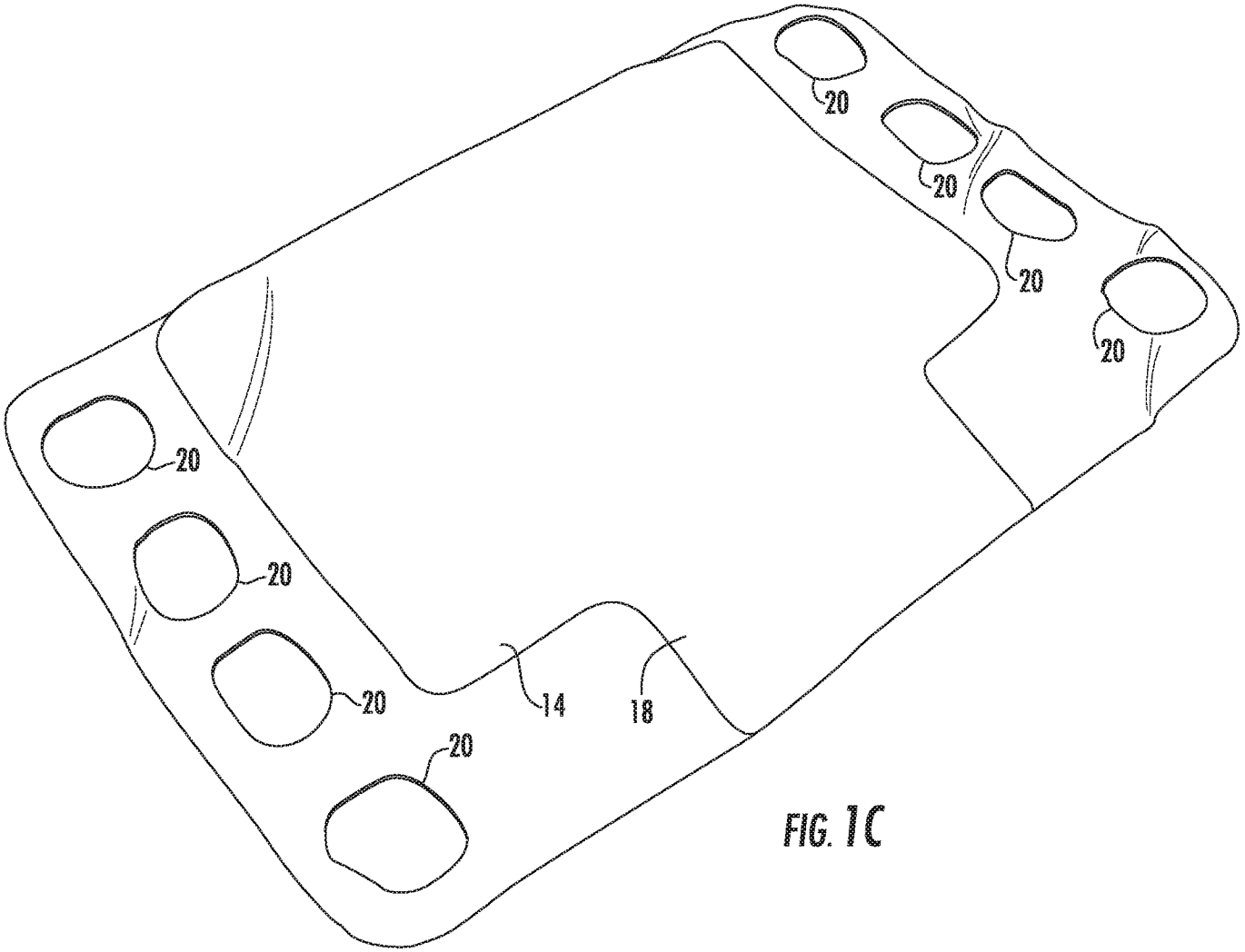

Reference will now be made in greater detail to a preferred embodiment of the invention, an example of which is illustrated in the accompanying drawings. Wherever possible, the same reference numerals will be used throughout the drawings and the description to refer to the same or like parts.

FIGS. 1-4 illustrate system for support of a body part of a patient turning and repositioning of the patient with simultaneous offloading of the bony prominences 10 in accordance with the teachings of the present invention. First ultra low pressure plenum 12 is configured to a shape to fit underneath a patient and support the lower back and/or hips of a patient. For example, first ultra low pressure plenum 12 can have a width W1 of approximately 52 inches, and a height H1 of about 35 inches. Alternatively, width W1 can be a width of a bed, such as a hospital bed. First ultra low pressure plenum 12 is formed of upper bladder 14 and lower bladder 16. First upper bladder 14 can have a width W2 and height H2. Lower bladder 16 has a smaller width dimension W3 and height dimension H3 than upper bladder 14. Air pressure within upper bladder 14 and lower bladder 16 is reduced sufficiently for distributing pressure within first ultra low pressure plenum 12, but is not providing support of the received body part by itself. Upper bladder section 14 extends between edges 13*a*-13*d*. Lower bladder section 16 extends between edges 15*a*-15*d*.

Gripping handles 20 can be provided on either edge 22*a*, 22*b* to aid in movement of first ultra low pressure plenum 12 over surface 19. Gripping handles 20 can be placed over a sheet of a bed and unweighted to allow the patient to be moved. In an alternative embodiment, gripping handles 20 are placed under the sheet and have a high coefficient of friction to prevent movement of first ultra low pressure plenum 12.

Figure 2:
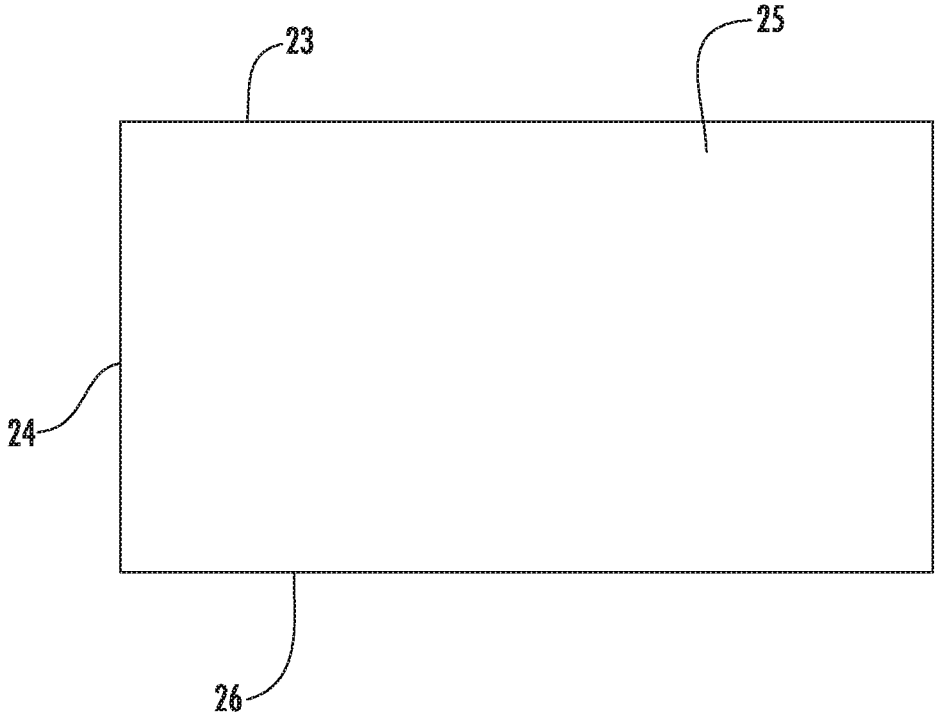
FIG. 2 is a schematic diagram of a positioner used in the system.

Positioner 23 can include bladder 24, as shown in FIG. 2. Bladder 24 is filled with fluidized material 25 which can retain its shape after sculpting. The flowability or lubricity of fluidized material 25 can be increased by adding a lubricant or by the removal of air from the interstitial spaces or both. The preferred medium of fluidized material 25 is a particulate material that has been modified in such a way that it acts like a fluid. Fluidized material 25 refers to a compound or composition which can be sculpted and retain its shape and has no memory or substantially no memory. The no memory or substantially no memory feature enables bladder 24 to increase in height and maintain support of a body part.

Fluidized material 25 is made of a viscosity that will allow it to contour but not collapse under the weight of the body part.

At sea level, the normal interstitial air pressure would exceed about 760 millibars of mercury. This increases or decreases marginally as altitude varies. Depending on the nature of the particulate fluidized material 25, the pressure can be lowered below about 500 millibars to about 5 millibars, preferably, 350 millibars to about 5 millibars, while still maintaining the necessary flow characteristics of the product.

Fluidized material 25 can include compressible and non-compressible beads, such as polyethylene or polystyrene (PS) beads, expanded polyethylene (PE), crosslinked expanded polyethylene (PE), polypropylene (PP) pellets, closed cell foams, microspheres, encapsulated phase changing materials (PCM). The beads can be hard shelled or flexible. In one embodiment, the beads are flexible and air can be evacuated from the beads. In one embodiment, hard beads can be mixed with flexible beads in which air can be evacuated from the flexible beads. In an alternative embodiment, fluidized material 25 can a porous foam substance including pockets of interstitial air. In one embodiment, fluidized material 25 can be a polyurethane foam. The polyurethane foam can be open or closed cell and cut into small shapes such as spheres or blocks. For example, a sphere of polyurethane foam can have a size of 2 inches in diameter. For example, a block of polyurethane foam can be a 1×1×1 inch block.

Suitable examples of fluidized material 25 can be formed of a mixture of microspheres and lubricant. The microspheres can include hollow or gas-filled structural bubbles (typically of glass or plastic) with an average diameter of less than 200 microns. The composition flows and stresses in response to a deforming pressure exerted on it and the composition ceases to flow and stress when the deforming pressure is terminated. For example, fluidized material 25 can be formed of a product referred to as Floam™. A flowable compound comprising lubricated microspheres, including the compound itself, formulations for making the compound, methods for making the compound, products made from the compound and methods for making products from the compound as defined by U.S. Pat. Nos. 5,421,874, 5,549,743, 5,626,657, 6,020,055, 6,197,099 and 8,175,585, each of which is hereby incorporated by reference into this application.

For example, bladder 24 can be formed of a flexible plastic, such as urethane. Upon removal of gas from fluidized material 25, bladder 24 flows concurrent with the flow of fluidized material 25 such that bladder 24 moves with movement of fluidized material 25. For example, the gas can be air, helium, hydrogen or nitrogen. Optionally, gas can communicate throughout the whole bladder for allowing maximum contouring and functional displacement of both the gas and the fluidized chamber thereby providing maximum contouring to a desired body part.

Figure 3:
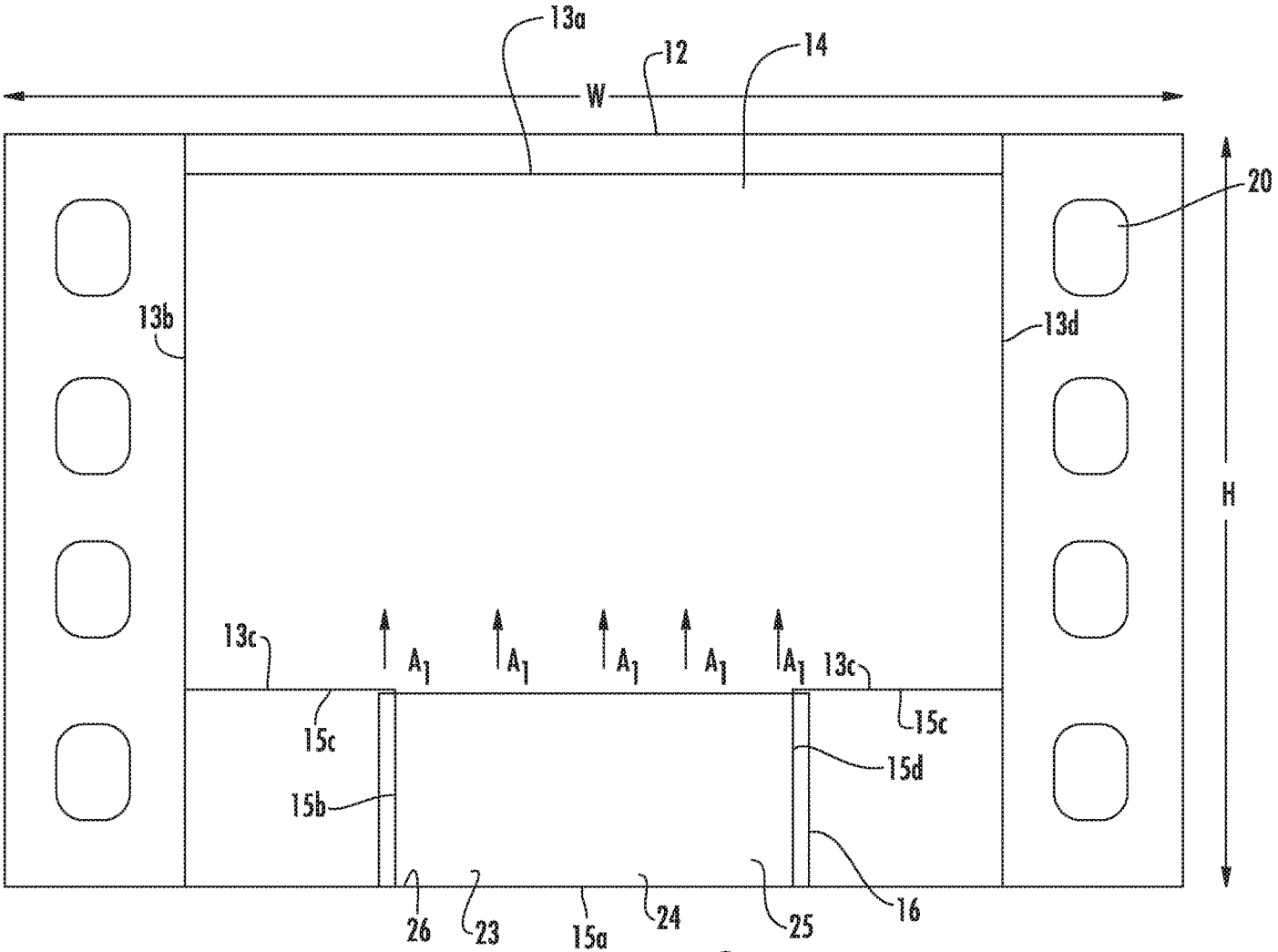
FIG. 3 is a schematic diagram of a second bladder used in the system.

FIG. 3 is a schematic diagram of second ultra low pressure plenum 32. Second ultra low pressure plenum 32 is formed of bladder 34. Second ultra low pressure plenum 32 can have a width W4 and a height H4 that is identical or substantially similar to height H2 and width W2 of upper bladder 14 of the first ultra low pressure plenum 12.

Figure 4:
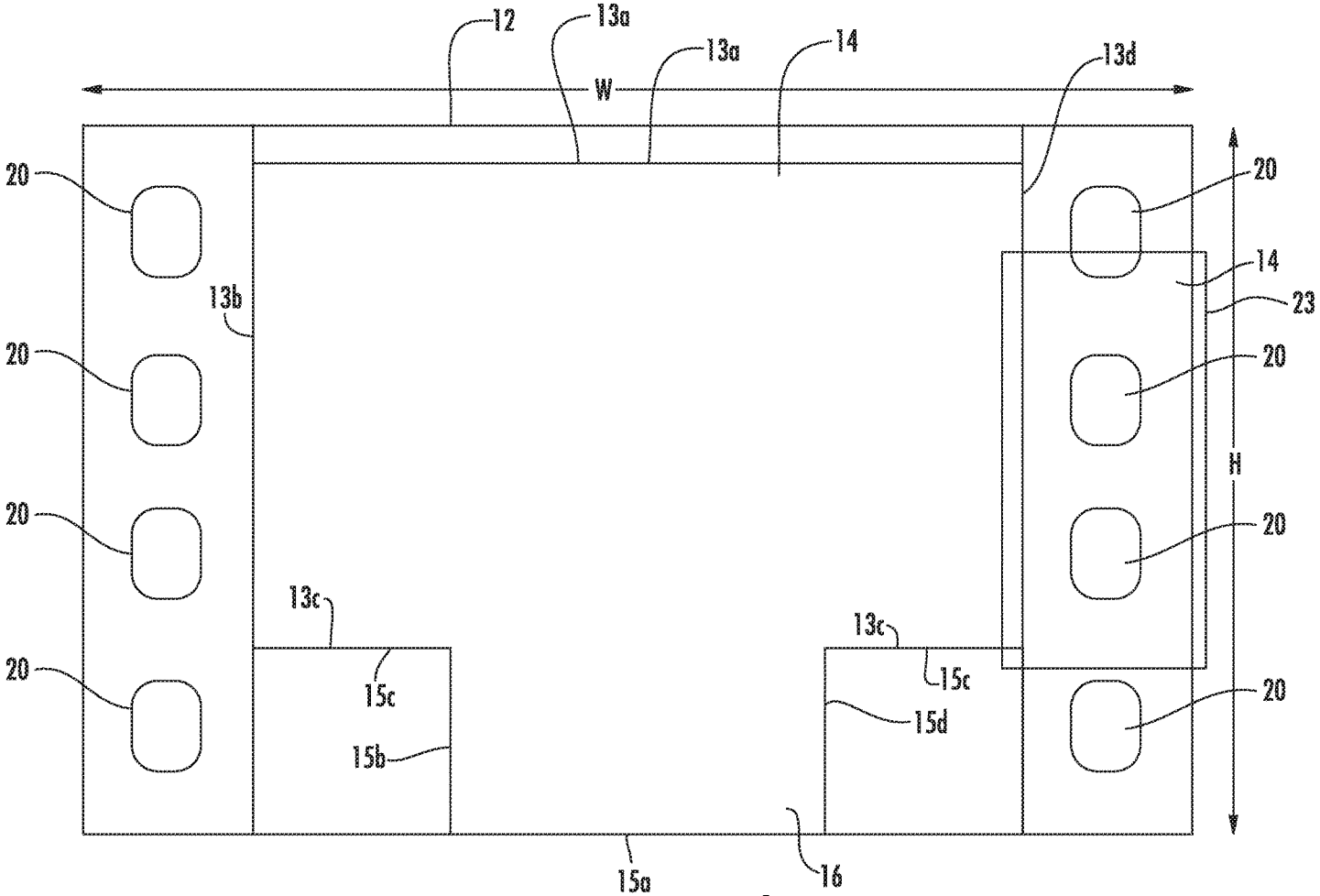
FIG. 4 is a schematic diagram of the system including the first and second bladders and the positioner.

Second ultra low pressure plenum 32 can be placed under first ultra low pressure plenum 12 as shown in FIG. 4. Alternatively, the second ultra low pressure plenum can be placed on top of the first ultra low pressure plenum. Positioner 23 is placed beneath both the first ultra low pressure plenum 12 and second ultra low pressure plenum 32. Positioner 23 displaces air in both the first ultra low pressure plenum 12 and second ultra low pressure plenum 32. Lower surface 26 of positioner 23 can be formed of a high friction material for preventing movement of positioner 23.

Bladder 24 is preferably filled with fluidized particulate material 25 with sufficient size and shape to displace an amount of gas in ultra low pressure plenum 12 and second ultra low pressure plenum 32 to offload pressure from the received body part, such as the bony prominences of the collar bone, rib cage and iliac crest when the body is in the prone position adjacent system 10. Bladder 24 provides micro-contouring because fluidized material 25 can respond three-dimensionally. Alternatively, bladder 24 is formed of any contouring medium, such as foam or gel which is sufficient to displace air within first ultra low pressure plenum 12 and second ultra low pressure plenum 32.

For example, the pressure in ultra low pressure plenum 12 and second ultra low pressure plenum 32 can be below 20 mm of water. It will be appreciated that all equivalents such as mm Hg and PSI can be used for measuring the pressure within ultra low pressure plenum 12 and second ultra low pressure plenum 32.

The pressure within ultra low pressure plenum 12 and second ultra low pressure plenum 32 can be below about 20 mm of water if no positioner 23 is used or if an area of less than about 30% of ultra low pressure plenum 12 and second ultra low pressure plenum 32 are covered by positioner 23. The pressure within ultra low pressure plenum 12 and second ultra low pressure plenum 32 can be below about 10 mm of water if an area of between about 30% to about 60% of ultra low pressure plenum 12 and second ultra low pressure plenum 32 is covered by positioner 23. The pressure within ultra low pressure plenum 12 and second ultra low pressure plenum 32 can be below about 5 mm of water if an area of greater than about 60% of ultra low pressure plenum 12 and second ultra low pressure plenum 32 are covered by positioner 23.

Bottom surface 17 of first ultra low pressure plenum 12 or second ultra low pressure plenum 32 can be formed of a material having a low coefficient of friction to be used to move a patient on surface 19 underneath first ultra low pressure plenum 12 or second ultra low pressure plenum 32. A suitable material having a low coefficient of friction is nylon or rip stop nylon material. Upper surface 18 of first ultra low pressure plenum 12 or second ultra low pressure plenum 32 can be formed of a material having a high coefficient of friction. A suitable material having a high coefficient of friction is a rubberized or non-skid material.

An additional positioner 23 can be placed over lower bladder 16 of ultra low pressure plenum 12 to displace gas from lower bladder 16 to upper bladder 14 in the direction of arrows $A_1$, as shown in FIG. 4 or at various locations on first ultra low pressure plenum 12 or second ultra low pressure plenum 32. When a patient is recumbent on first ultra low pressure plenum 12 and second ultra low pressure plenum 32 gas will be displaced in upper bladder 14 and second ultra low pressure plenum 32. towards outer edges 13*a* for providing support adjacent to edges 13*b* and 13*d* thereby providing support of edges 13*b* and 13*d* of upper bladder 14 of the patient within edges 13*b* and 13*d* and to the edges of bladder 34 for lifting a patient from surface 11.

Figure 5:
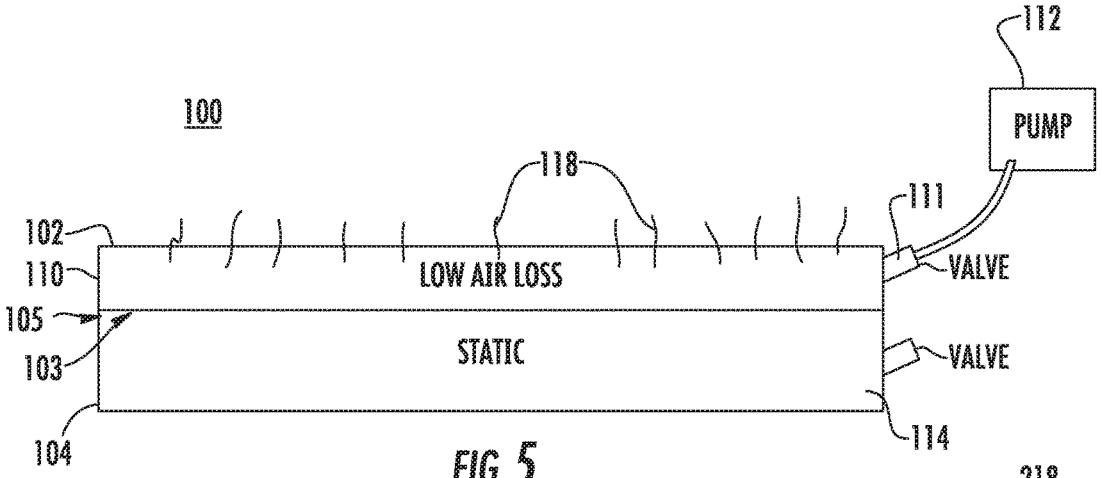
FIG. 5 is a schematic diagram of an alternate embodiment of a system for support of a body part in accordance with the teachings of the present invention which provides low pressure loss.

In one embodiment, positioner 23 can be positioned at one of edges 13*b* and 13*d* to push air away from respective edges 13*b* and 13*d* thereby aiding in turning of a patient towards the opposite edge, as shown in FIG. 5. For example, if the patient is to be turned towards edge 13*d*, positioner 23 can be placed at edge 13*b* for displacing gas behind the patient to towards edge 13*b* of upper bladder 14, thereby pneumatically assisting in turning of the patient to face edge 13*d*.

System 10 including ultra low pressure plenum 12 and second ultra low pressure plenum 32 is functional whether positioner 23 is placed on top of ultra low pressure plenum 12 and second ultra low pressure plenum 32 or beneath ultra low pressure plenum 12 and second ultra low pressure plenum 32.

Figure 6:
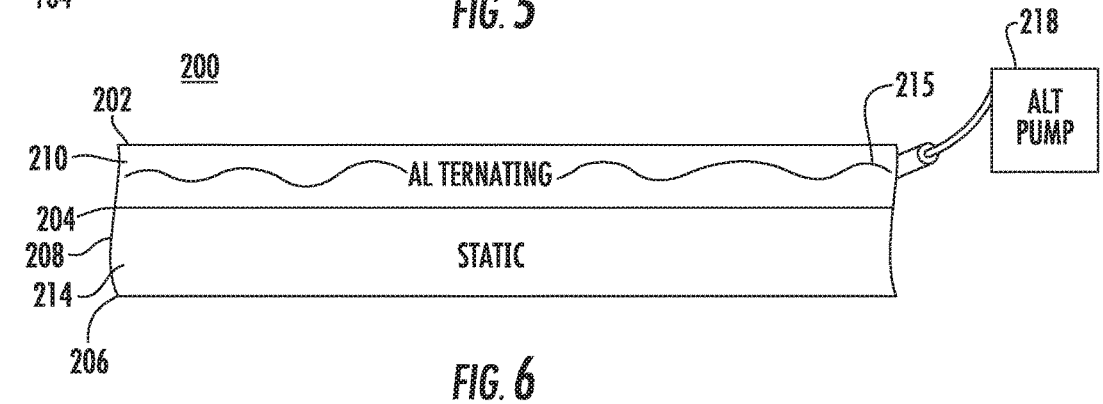
FIG. 6 is a schematic diagram of an alternate embodiment of a system support of a body part in accordance with the teachings of the present invention which provides alternating pressure.

FIGS. 6-17 illustrate system for support of a body part of a patient turning and repositioning of the patient with simultaneous offloading of the bony prominences 300 in accordance with the teachings of the present invention. System 300 includes first ultra low pressure plenum 312 and second low pressure plenum 332, as shown in FIG. 6. First ultra low pressure plenum 312 is configured to a shape to fit underneath a patient and support the lower back and/or hips of a patient. First ultra low pressure plenum 312 can include upper bladder 314 and extension bladder 315. Extension bladder 315 extends from upper bladder 314. Extension bladder 315 and upper bladder 314 can be integral to one another. Air pressure within upper bladder 314 and extension bladder 315 is reduced sufficiently for distributing pressure within first ultra low pressure plenum 312, but is not providing support of the received body part by itself. Second ultra low pressure plenum 332 is formed of bladder 334. Second ultra low pressure plenum 32 can be placed under first ultra low pressure plenum 12. Dimples 311 can be formed in first ultra low pressure plenum 312 and dimples 331 can be formed in second ultra low pressure plenum 332. Dimples 311 and dimples 331 can be aligned with one another.

Figure 7:
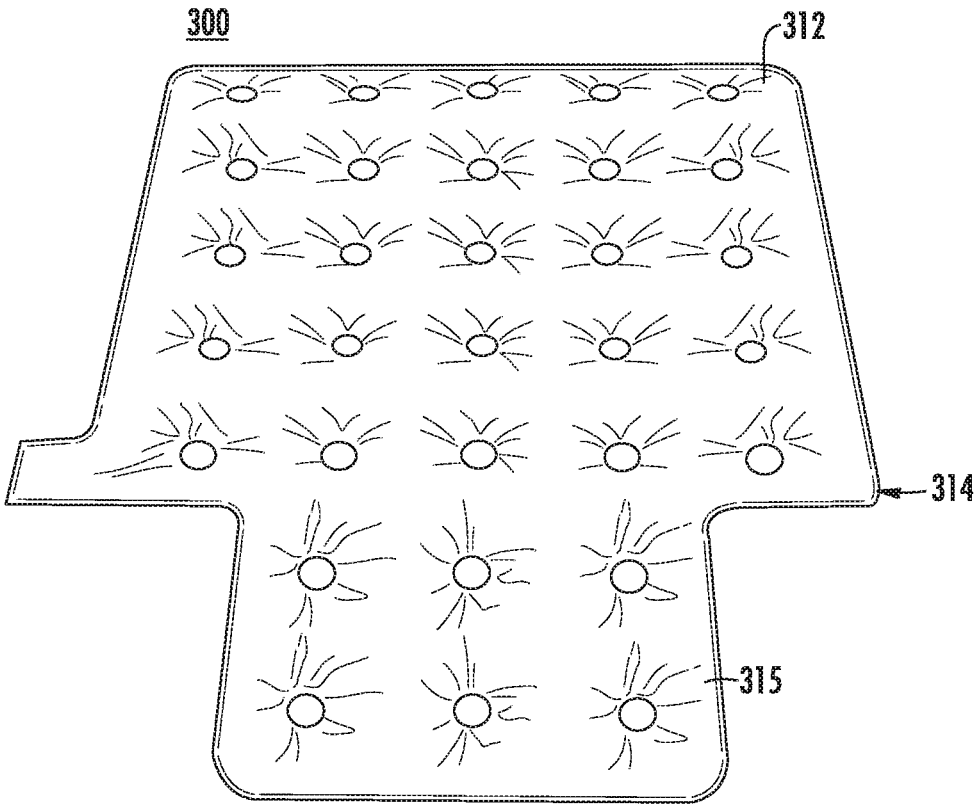
FIG. 7 is a schematic diagram of a support used in an alternate embodiment of a system for sacral and trochanteric support in accordance with the teachings of the present invention.
Figure 8:
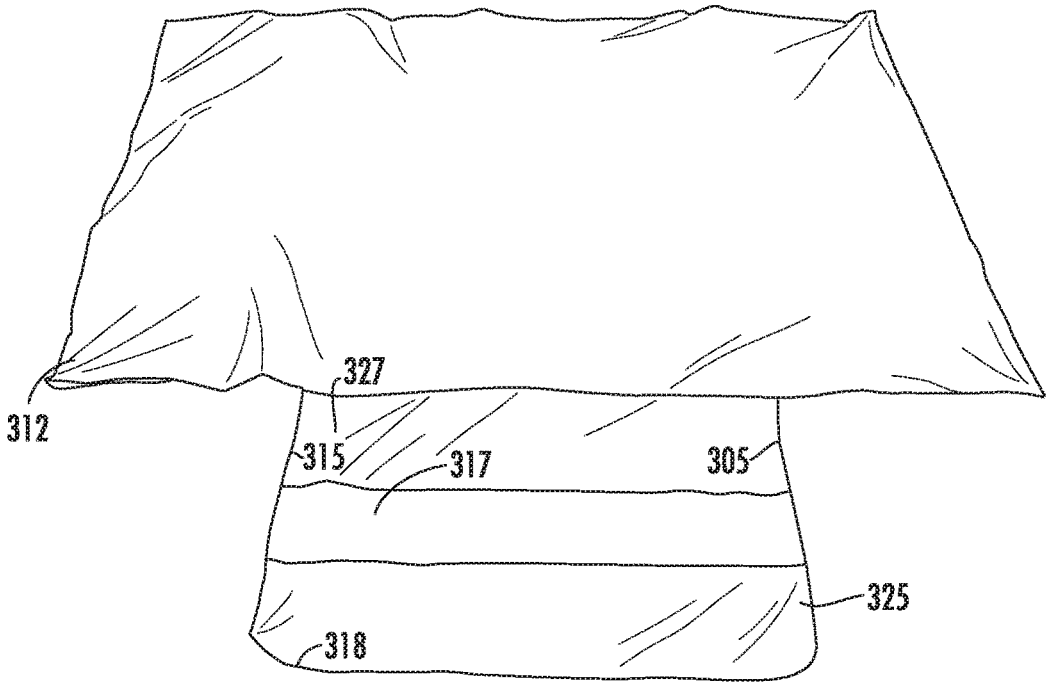
FIG. 8 is a front view of a cover placed over the support shown in FIG. 7.
Figure 9:
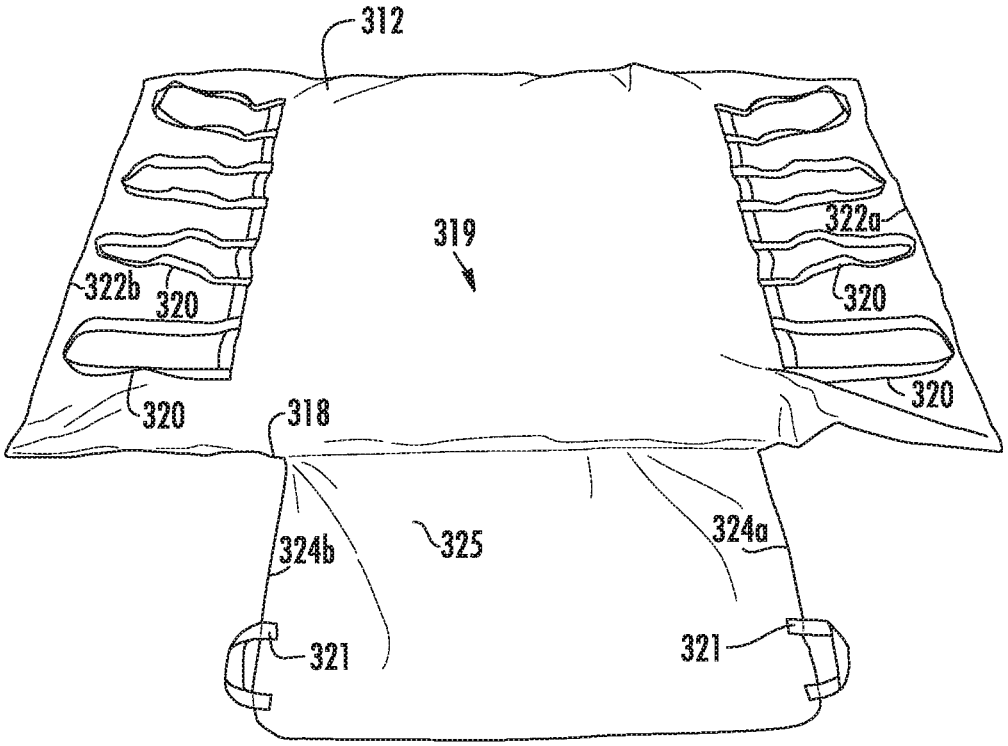
FIG. 9 is a rear view of a cover placed over the support shown in FIG. 7.

Cover 318 can be placed around first ultra low pressure plenum 312 and second ultra low pressure plenum, as shown in FIGS. 7-9. Cover 318 can be formed of a material having a low coefficient of friction. A suitable material having a low coefficient of friction is nylon or rip stop nylon material. Extension 325 of cover 318 receives extension bladder 315.

Portion 317 on upper surface 327 of extension 325 can be formed of a material having a high coefficient of friction. A suitable material having a high coefficient of friction is a rubberized or non-skid material. Portion 317 can be folded underneath rear surface 319 of upper bladder 314 to prevent movement of ultra low pressure plenum 312, as shown in FIG. 9. Handles 320 can be provided adjacent either edge 322*a*, 322*b* of cover 318 to aid in movement. Handles 321 can be provided adjacent either edge 324*a*, 324*b* of extension 325 of cover 318 to aid in folding of extension 325 underneath rear surface 319.

Figure 10:
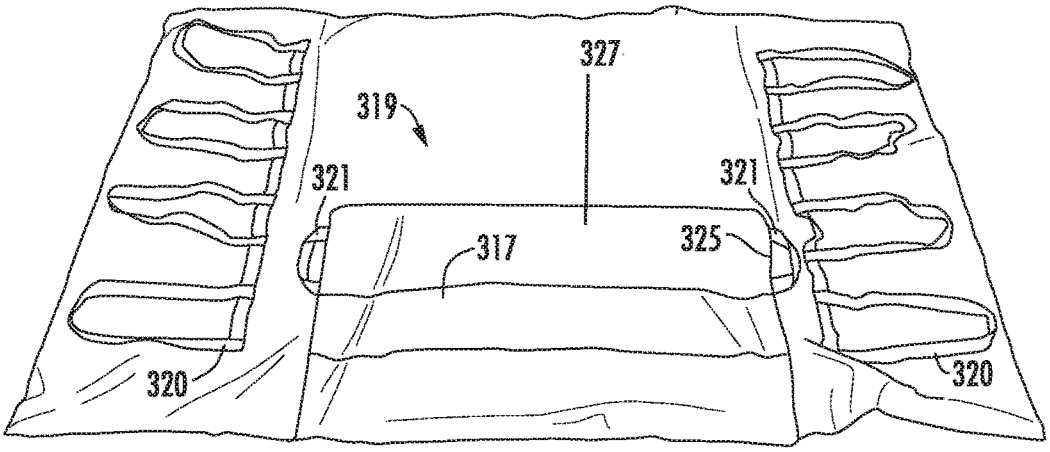
FIG. 10 is a rear view of a cover placed over the support shown in FIG. 7 including an extension of the support placed in a folded condition.
Figure 11:
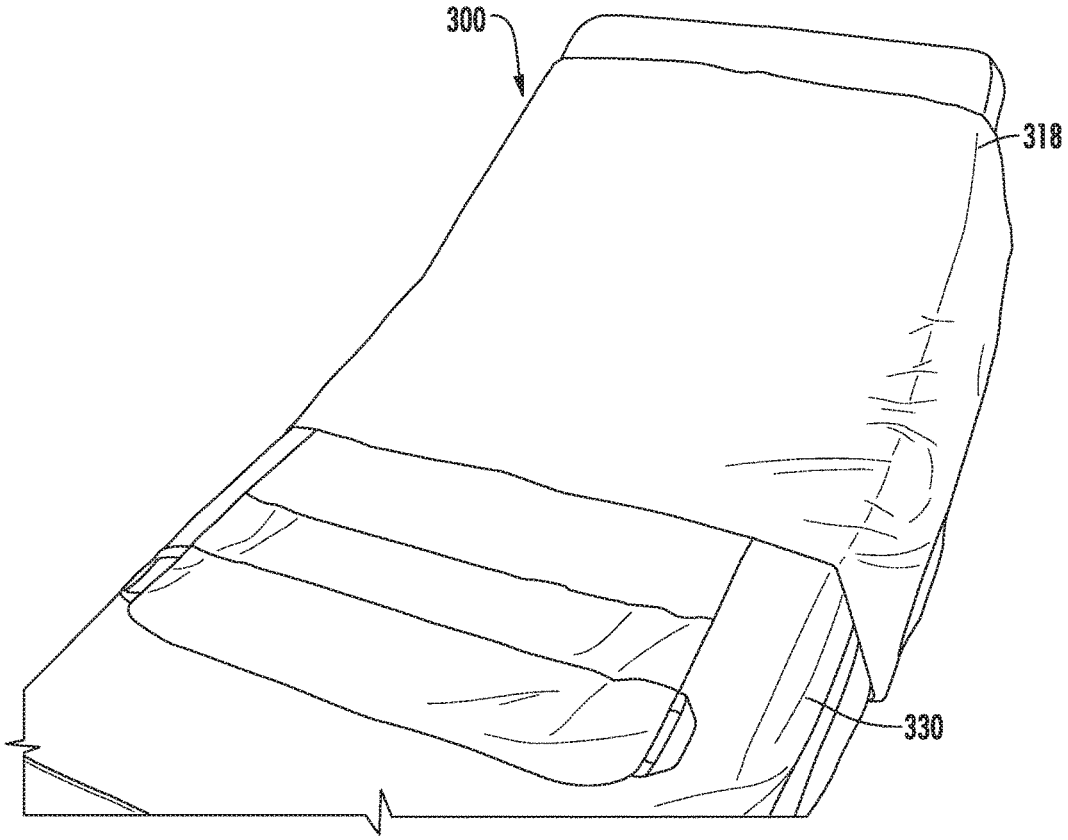
FIG. 11 is a schematic diagram of the system for sacral and trochanteric support in accordance with the teachings of the present invention when placed on a bed.

FIGS. 10-17 illustrate use of system for support of a body part of a user turning and repositioning of the user with simultaneous offloading of the bony prominences 300. In FIG. 10, system for support of a body part of a user turning and repositioning of the user with simultaneous offloading of the bony prominences 300 can be placed on bed 330. System 300 can be moved to different positions on bed 330 using handles 320, as shown in FIG. 11.

Figure 12:
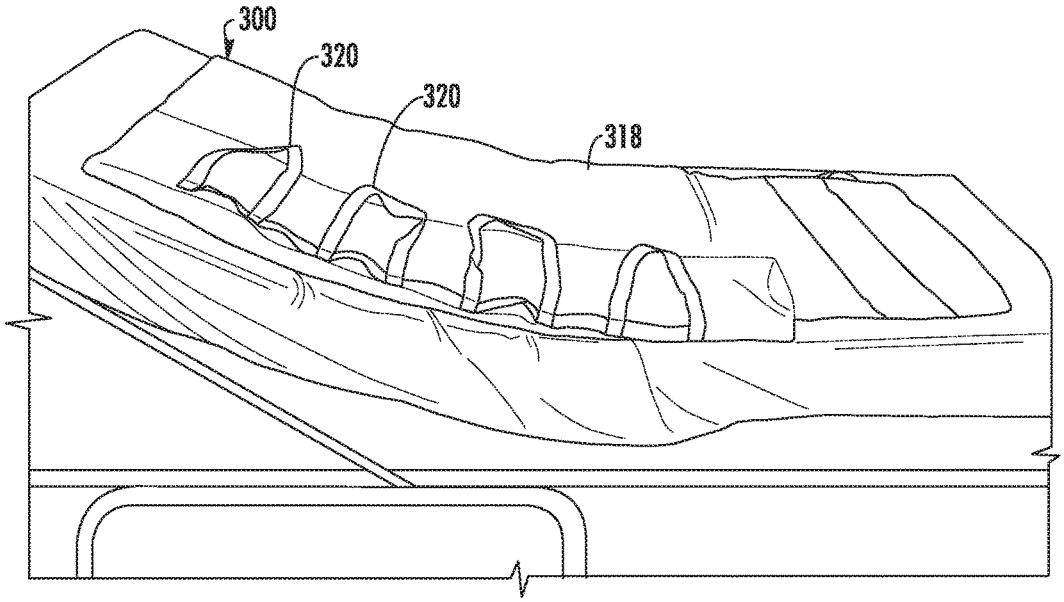
FIG. 12 is a schematic diagram of the system for sacral and trochanteric support in accordance with the teachings of the present invention when placed on a bed and having one side folded to expose handles attached to a rear side of the support.
Figure 13:
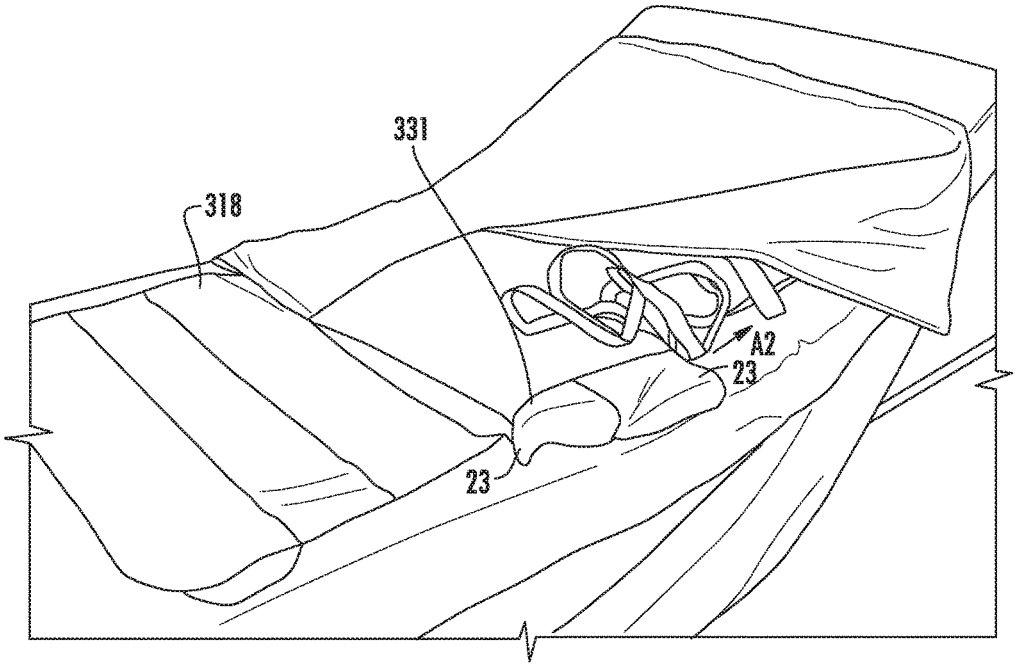
FIG. 13 is a schematic diagram of the system for sacral and trochanteric support in accordance with the teachings of the present invention when placed on a bed and including a positioner placed in a retainer of the cover.
Figure 14:
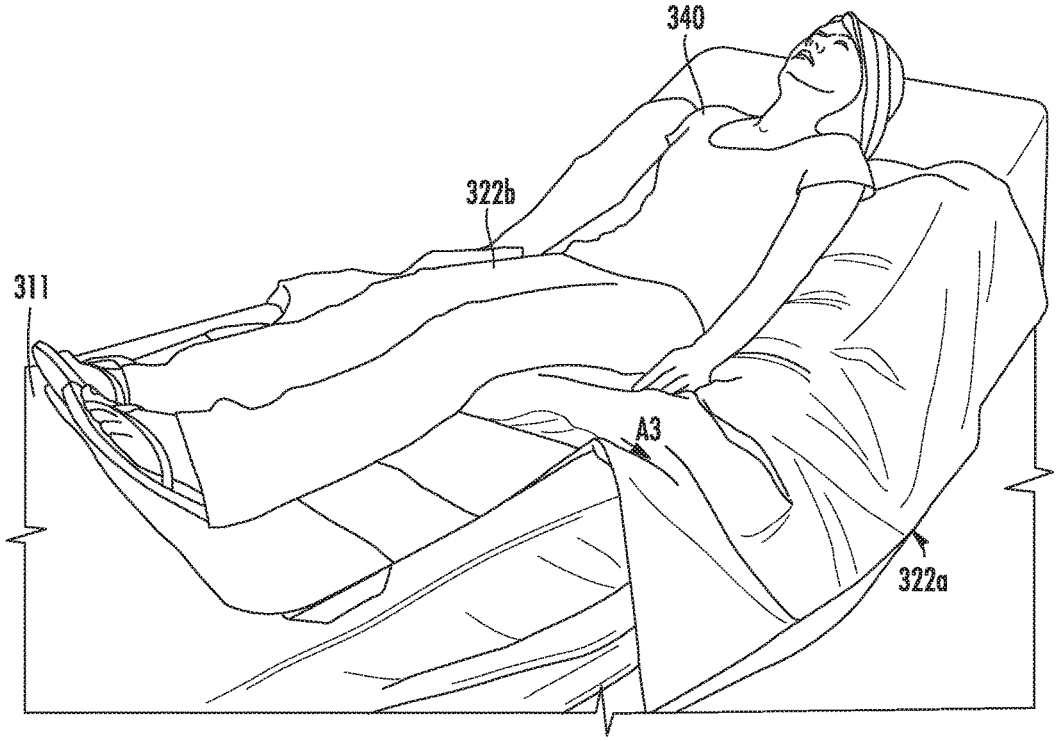
FIG. 14 is a schematic diagram of the system for sacral and trochanteric support in accordance with the teachings of the present invention when placed on a bed and in use by a user.
Figure 15:
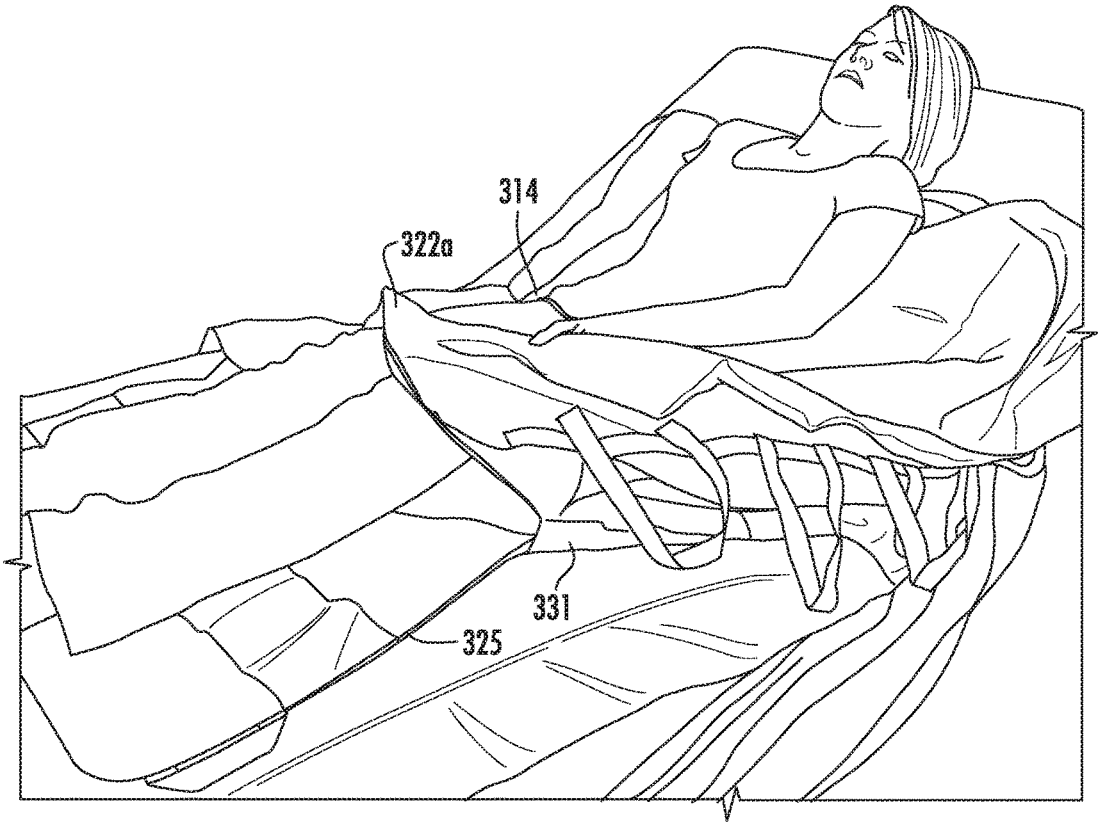
FIG. 15 is a schematic diagram of the system for sacral and trochanteric support in accordance with the teachings of the present invention when placed on a bed and in use by a user during folding of an edge towards the user.

Positioner 23 can be placed within pocket 331 of cover 318 to retain positioner 23. Positioner 23 can be placed over upper bladder 314 of first ultra low pressure plenum 312 to displace gas in the direction of arrow $A_2$, as shown in FIG. 12. When a user is recumbent on first ultra low pressure plenum 312 with their sacrum received on positioner 23, gas will be displaced in upper bladder 314 in the direction of arrow $A_3$ towards outer edges 322*a*, 322*b* for providing support adjacent to edges 322*a* and 322*b* thereby providing support of the user within edges 322*a* and 322*b* and lifting user 340 from surface 311 of bed 330 and offloading the sacrum and trochanter of user 340, as shown in FIG. 13 and allow the body to be rotated over the support or bed. Additional positioners 23 can be placed in pocket 331 of cover 118 by lifting edge 322*a* to provide additional displacement of gas within upper bladder 314 as shown in FIG. 14. Extension 325 can be folded underneath rear surface 319 of upper bladder 314 to prevent movement of ultra low pressure plenum 312, as shown in FIG. 15.

Figure 16:
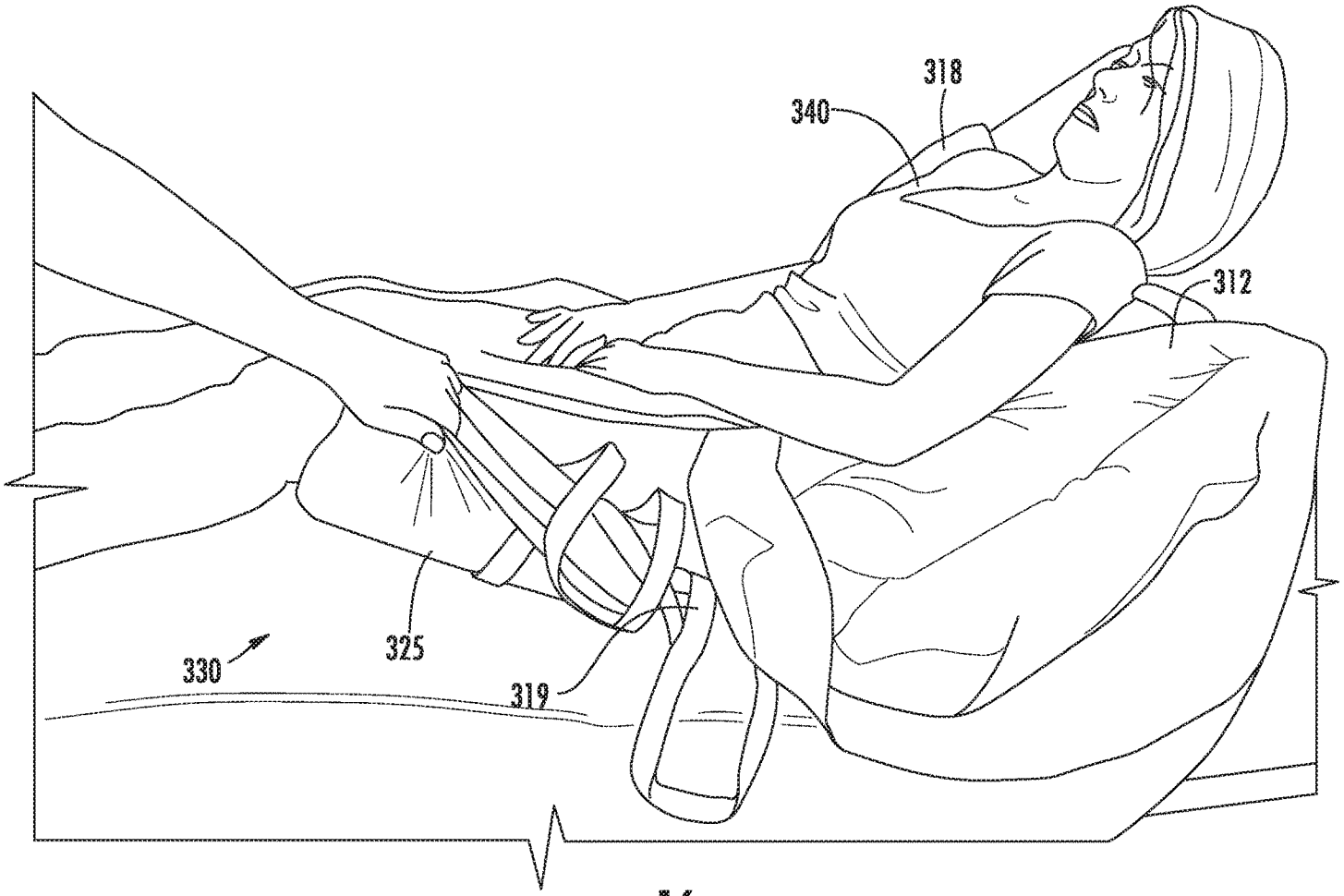
FIG. 16 is a schematic diagram of the system for sacral and trochanteric support in accordance with the teachings of the present invention when placed on a bed and in use by a user during folding of an extension of the cover and support.
Figure 17:
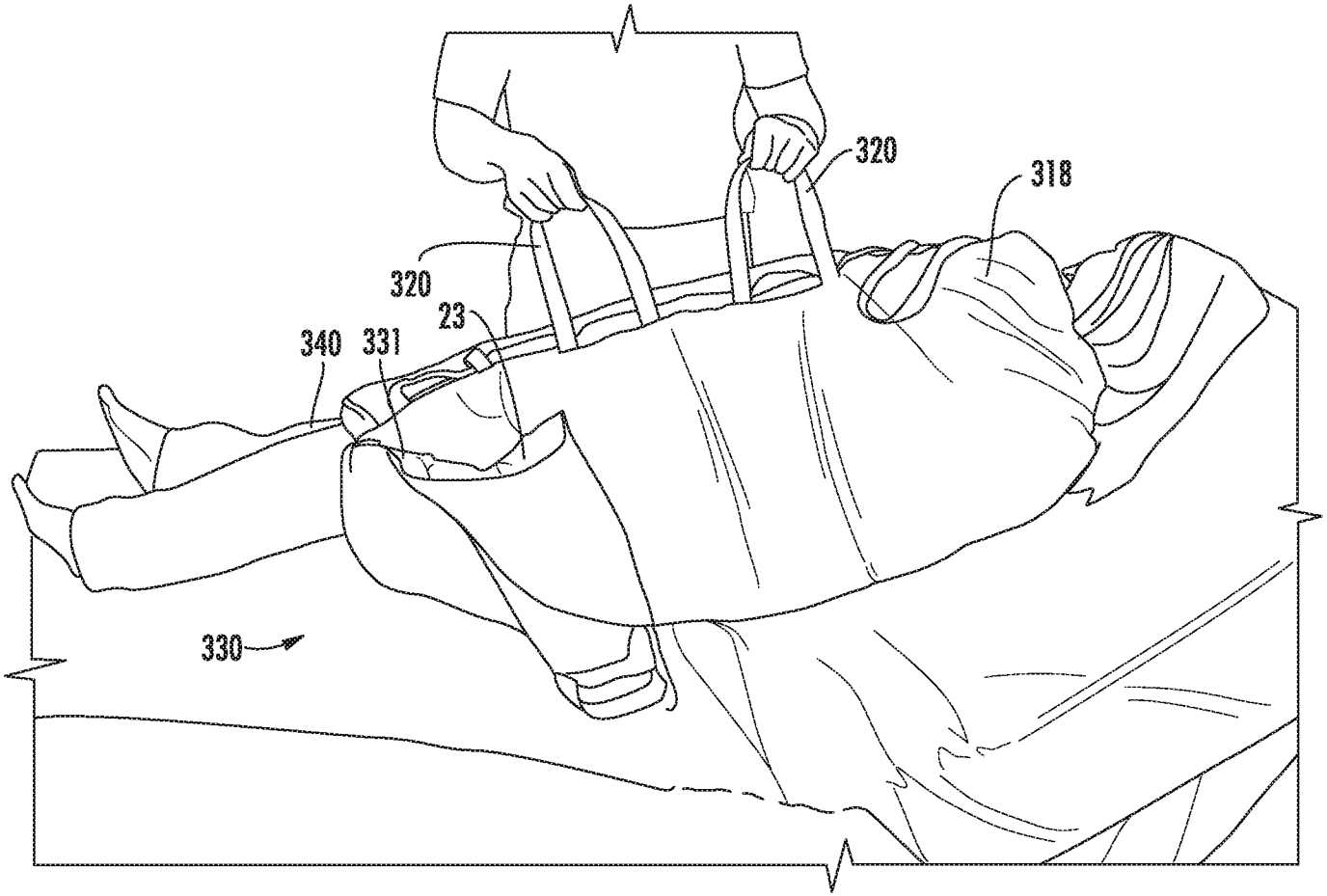
FIG. 17 is a schematic diagram of the system for sacral and trochanteric support in accordance with the teachings of the present invention when placed on a bed and in use by a user during turning of the user.

In one embodiment, user 340 can be moved or turned by using handles 320, as shown in FIG. 16. In one embodiment, positioner 23 can be positioned behind a side of cover 318 to push gas away from edges 322*a*, thereby aiding in turning of a user towards the opposite edge, as shown in FIG. 17. For example, if the patient is to be turned towards edge 322*b*, positioner 23 can be placed at edge 322*a* for displacing gas behind the patient to towards edge 322*b* of upper bladder 314, thereby pneumatically assisting in turning of the patient to face edge 322*b*.

Figure 18:
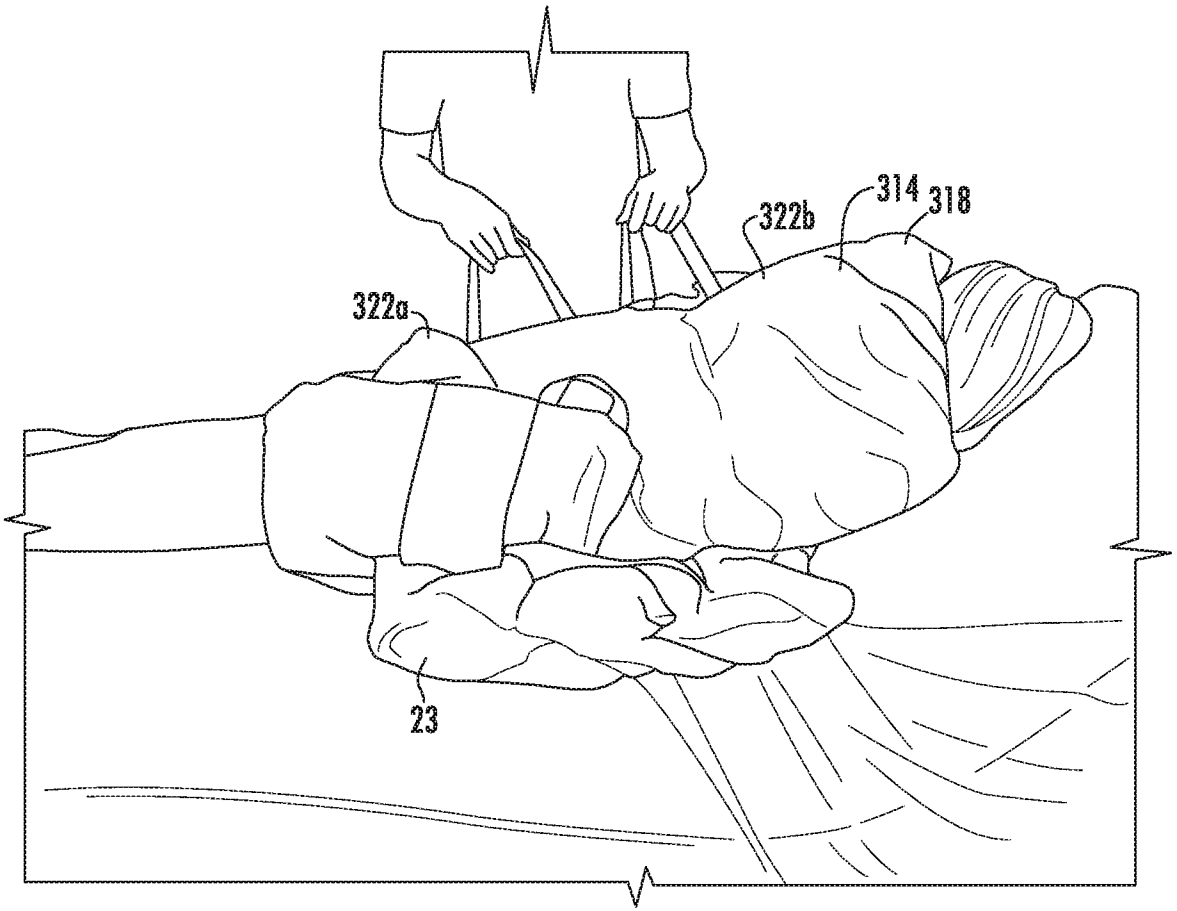
FIG. 18 is a schematic diagram of the system for sacral and trochanteric support in accordance with the teachings of the present invention when placed on a bed and in use including use of a positioner to aid in turning.
Figure 19:
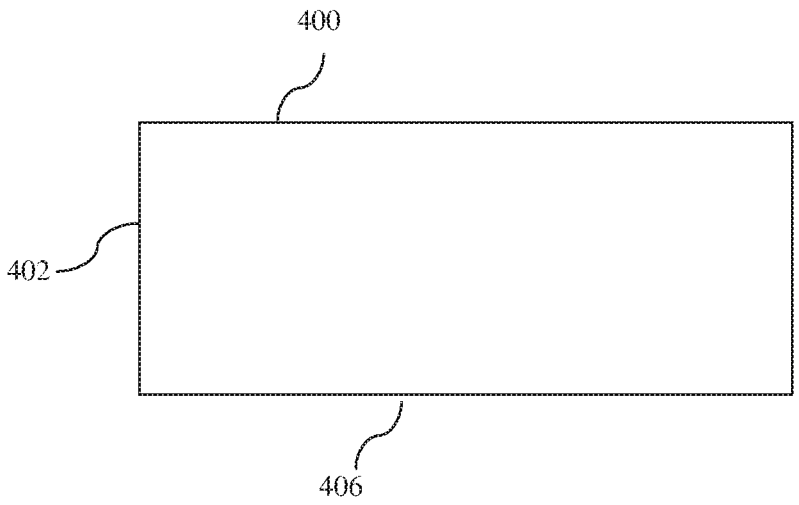
FIG. 19 is a schematic diagram of an alternate embodiment of a positioner used in the system for sacral and trochanteric support.

In one embodiment, positioner 400 can include ultra low pressure bladder 402, as shown in FIG. 18. The pressure within ultra low pressure bladder 402 is a range of less than about 20 mm of water to about 5 mm of water or a range of less than about 10 mm of water to about 5 mm of water. It will be appreciated that all equivalents such as mm Hg and PSI can be used for measuring the pressure within ultra low pressure bladder 402. In this embodiment, positioner 400 is formed with sufficient size and shape to displace an amount of gas in ultra low pressure bladder 402 to offload pressure from the received body part. Lower surface 406 of positioner 400 can be formed of a high friction material for preventing movement of positioner 400. Positioner 400 can be placed on top of first ultra low pressure plenum 12 and/or or second ultra low pressure plenum 32 or beneath ultra low pressure plenum 12 and/or second ultra low pressure plenum 32.

Positioner 400 can be placed over lower bladder 16 of ultra low pressure plenum 12 to displace gas from lower bladder 16 to upper bladder 14 in the direction of arrows $A_1$, as shown in FIG. 4.

In one embodiment, positioner 23 can be used together with positioner 400. Positioner 400 can be placed over lower bladder 16 of ultra low pressure plenum 12 positioner 23 can be positioned at one of edges 13*b* and 13*d* to push air away from respective edges 13*b* and 13*d* thereby aiding in turning of a patient towards the opposite edge, similar to positioner 23 as shown in FIG. 5. For example, if the patient is to be turned towards edge 13*d*, positioner 23 can be placed at edge 13*b* for displacing gas behind the patient to towards edge 13*b* of upper bladder 14, thereby pneumatically assisting in turning of the patient to face edge 13*d*.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A system for patient turning and positioning, comprising:

a first low pressure air plenum with a pressure that is less than about 20 mm of water;

a second low pressure air plenum with a pressure that is less than about 20 mm of water, the first and second low pressure air plenums comprising static air plenums with a fixed amount of air therein, the first and second low pressure static air plenums forming a mattress overlay, wherein at least a portion of the first low pressure air plenum comprises a higher coefficient of friction than at least a portion of the second low pressure air plenum.

2. The system of claim 1, wherein the first and second low pressure static air plenums are attached to one another.

3. The system of claim 1, wherein the first low pressure air plenum is positioned below the second low pressure air plenum.

4. A system for patient turning and positioning, comprising:

a plenum comprising a fixed amount of static gas therein, the plenum comprising an upper bladder having a first width configured to a shape to fit underneath a patient's back and an extension bladder having a second width that is smaller than the first width, wherein at least a portion of the extension bladder comprises a higher coefficient of friction than at least a portion of the upper bladder.

5. The system of claim 4, further comprising at least one first set of gripping handles configured to be located at an edge of the upper bladder and at least one second set of gripping handles configured to be located at an edge of the extension bladder, wherein the at least one second set of gripping handles allows the extension bladder to be folded underneath the upper bladder.

6. The system of claim 5, further comprising a cover configured to receive the plenum, wherein the at least one first and second sets of gripping handles are attached to the cover.

7. The system of claim 5, wherein gripping at least one handle of the first set of gripping handles creates a sling that allows a patient positioned on the plenum to be turned or moved.

8. The system of claim 5, wherein the at least one first set of gripping handles comprises a plurality of handles positioned along left and right sides of the upper bladder.

9. The system of claim 5, wherein the at least one second set of gripping handles comprises at least one handle positioned along a left side of the extension bladder and at least one handle positioned along a right side of the extension bladder.

10. The system of claim 4, further comprising a cover configured to receive the plenum, wherein at least a portion of the cover that receives the extension bladder comprises a higher coefficient of friction than at least a portion of the cover that receives the upper bladder.

11. The system of claim 4, further comprising a cover configured to receive the plenum, wherein the cover comprises a first surface having a first coefficient of friction and a second surface having a second coefficient of friction.

12. The system of claim 11, wherein the first coefficient of friction is different from the second coefficient of friction.

13. The system of claim 12, wherein the first coefficient of friction is provided on the at least a portion of the extension bladder that comprises a higher coefficient of friction than at least a portion of the upper bladder, and wherein the second coefficient of friction is provided on at least a portion of the upper bladder.

14. The system of claim 4, wherein the plenum comprises a profile configured to be positioned underneath sheets of a bed.

15. The system of claim 4, wherein the fixed amount of static gas in the plenum comprises a constant pressure below about 20 mm of water.

16. The system of claim 4, wherein the fixed amount of static gas in the plenum comprises a constant pressure below about 5 mm of water.

17. The system of claim 4, further comprising a positioner configured to be positioned beneath the plenum in use.

18. The system of claim 4, wherein, in a first configuration, the extension bladder is coplanar with the upper bladder, and wherein, and a second configuration, the extension bladder is folded underneath at least a portion of the upper bladder.

19. The system of claim 4, wherein the upper bladder is configured to be positioned beneath a patient's back and wherein the extension bladder is configured to be positioned beneath a patient's legs.

20. A system for patient turning and positioning, comprising:

a plenum comprising a fixed amount of static gas therein, the plenum comprising an upper bladder having a first width configured to a shape to fit underneath a patient's back and an extension bladder having a second width that is smaller than the first width, wherein at least a portion of the extension bladder comprises a first coefficient of friction and wherein at least a portion of the upper bladder comprises a second coefficient of friction.

21. The system of claim 20, wherein, in a first configuration, the extension bladder is coplanar with the upper bladder, and wherein, and a second configuration, the extension bladder is folded underneath at least a portion of the upper bladder.

22. The system of claim 21, wherein the first coefficient of friction is such that the extension bladder is prevented from slipping when folded underneath at least a portion of the upper bladder.

23. The system of claim 20, wherein the upper bladder is configured to be positioned beneath a patient's back and wherein the extension bladder is configured to be positioned beneath a patient's legs.

* * * * *